US005133199A

United States Patent [19]

Parikh et al.

[11] Patent Number: 5,133,199

[45] Date of Patent: Jul. 28, 1992

[54] CONFORMABLE STRETCH BANDAGE

[75] Inventors: Dharni V. Parikh, Medfield; Joseph N. Kent, Cohasset, both of Mass.

[73] Assignee: The Kendall Company, Mansfield, Mass.

[21] Appl. No.: 743,969

[22] Filed: Oct. 11, 1991

Related U.S. Application Data

[63] Continuation of Ser. No. 624,840, Dec. 10, 1990, abandoned.

[51] Int. Cl.[5] ..... D04B 7/12

[52] U.S. Cl. ..... 66/192; 428/253; 602/76; 66/193

[58] Field of Search ..... 66/192, 193; 602/76; 428/253

[56] References Cited

U.S. PATENT DOCUMENTS 4,173,131 11/1979 Pendergrass et al. ..... 66/193

*Primary Examiner*—James J. Bell

*Attorney, Agent, or Firm*—Alvin Isaacs

[57] ABSTRACT

A lightweight, porous knitted elastic bandage produced from a warp of false-twist synthetic yarns with a filling inlay of cotton yarn arranged in varying patterns across the warp yarns, wherein the filling cotton yarn is slack mercerized whereby to provide increased ply adhesion over that of the regular cotton yarn.

17 Claims, 1 Drawing Sheet

CONFORMABLE STRETCH BANDAGE

RELATED APPLICATION

This application is a continuation of Application Ser. No. 624,840 filed Dec. 10, 1990, now abandoned.

BACKGROUND OF THE INVENTION

Various conformable stretch bandages are known in the art, including the patent literature. While not intended to represent an exhaustive search, the following patents are nevertheless illustrative.

U.S. Pat. No. 2,379,574 of Goldthwait discloses an absorbent gauze having elasticity in both the length and cross directions. As described and claimed, the bandage is prepared by treating an open weave cotton fabric with a swelling agent for cellulose (sodium hydroxide being specifically disclosed) without applying tension to cause the fabric to shrink in all directions, thereby imparting many small spring-like crimps. The bandage is said to be self-fitting, self-tightening if applied with a slight stretch, flexible and elastic.

U.S. Pat. No. 2,404,837, also to Goldthwait, is said to be directed to a similar bandage, except that the improved elastic properties are present in only one direction at a time instead of in both directions at once. Accordingly, surface properties causing layers of the fabric to resist slipping are developed to a lesser degree (Col. 1). The bandage is prepared by allowing shrinkage to take place in only one direction while restraint is exerted to prevent shrinking in the other direction; or allowing the shrinkage to take place in both directions and then pulling the fabric back by tension in one direction.

U.S. Pat. No. 4,041,581 and a division thereof, 4,118,841 issued to Diggle disclose a method and apparatus for preparing an improved bandage gauze said to have increased crimp and bulk and a desirable degree of lengthwise stretch. Specifically, a system is described and claimed for the mechanical compressive shrinkage of woven gauze bandage in multiple-ply form in a two-roll differential speed mechanical compactor.

A particularly useful elastic bandage is described and claimed in U.S. Pat. No. 4,173,131 issued to Pendergrass, which patent will be discussed in detail hereinafter.

U.S. Pat. No. 4,775,579 of Hagy et al discloses an elastic nonwoven fabric suitable for use as a surgical bandage, which fabric comprises 15 to 80 weight percent of an elastic synthetic polymer web or net and 20 to 85 weight percent absorbent staple fibers hydraulically entangled in the elastic polymer web.

Finally, U.S. Pat. No. 4,820,572 issued to Killian et al teaches a composite elastic non-woven web comprised of a coherent matrix of meltblown fibers of a specified polyether block amide copolymer and at least one type of other fibers.

As heretofore alluded to, a particularly efficacious porous elastic bandage is described and claimed in U.S. Pat. No. 4,173,131. According to the patented teachings, a lightweight, porous knitted elastic bandage is produced from a warp of false-twist synthetic yarns with a filling inlay of regular yarns. The filling yarns are arranged in varying patterns across the warp yarns so that a portion of their length lies in looped and cursive configuration upon the surface of the bandage, and the structure is so open that overlapping layers of the bandage cling to each other in substantially non-displaceable relationship.

As stated commencing at the bottom of Col. 1:

In addition to the patent literature, conformable stretch bandages are commercially available.

For example, The Kendall Company, assignee of the present invention, manufactures and sells under their trademark "CONFORM" a lightweight bandage within the scope of the aforementioned U.S. Pat. No. 4,173,131. The CONFORM elastic bandage, which possesses moderate elasticity and softness, is described as having a unique crocheted construction which holds securely to any body contour, while still allowing freedom of movement.

Another commercially available gauze bandage, "KLING"(trademark of Johnson & Johnson) is stated to be a rolled bandage for securing hard-to-manage areas or where flexibility is important, which bandage clings to itself and is said to be soft, absorbent and flexible so that it moves with you but remains comfortable and secure.

While elastic bandages of the type disclosed in U.S. Pat. No. 4,173,131 and exemplified by the commercially available "CONFORM" bandage are highly useful for such purposes as for applying compressive pressure over a primary dressing and in general compare most favorably in performance with other elastic bandages, it is nevertheless desired to provide still better ply adhesion (shear strength).

Accordingly, stated simply, the task of the present invention is to provide crochet knitted elastic bandages produced from a warp of false twist synthetic yarns with a filling inlay of regular yarns and which are characterized by having both improved ply adhesion.

BRIEF DESCRIPTION OF THE INVENTION

In accordance with the present invention, this task is solved in an elegant manner by employing a slack mercerized cotton yarn in the inlay filling (cross-direction) and a polyester or polyester/cotton blend in the warp (machine direction).

DETAILED DESCRIPTION OF THE INVENTION

Figure 1:
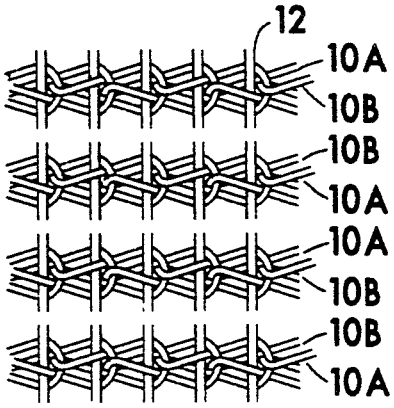
FIG. 1, which is identical to FIG. 4 of the aforementioned U.S. Pat. No. 4,173,131, of the warp and filling yarns in the bandages of this invention.
Figure 2:
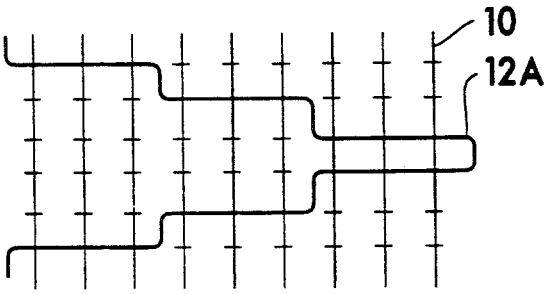
FIGS. 2, 3, 4 and 5, which are identical to FIGS. 5, 6, 7 and 8, respectively of the aforementioned 3 131 patent, represent the paths of the individual filling yarns in one repeat of a preferred embodiment of this invention.
Figure 3:
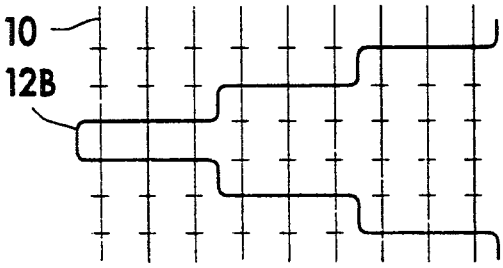
Figure 4:
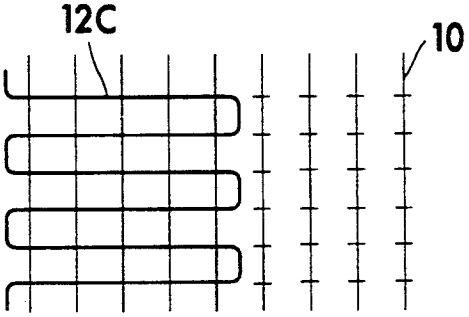
Figure 5:
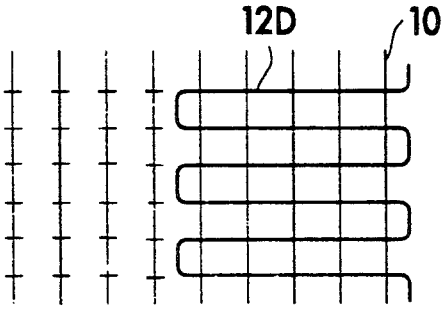

Elastic bandages are of course well known in the art, finding particular use for such purposes as applying over a primary dressing for treatment of wounds, e.g. ulcers, requiring both a dressing and the application of mild compressive pressure. By wrapping the bandage with overlapping plies in a manner while applying or exerting slight tension, a compressive force is applied to the wound. Such bandages are preferably further characterized as being adhesive-free, in which case the bandage must possess ply adhesion or the ability of one ply to adhere to the underlying ply so that the bandage can retain in place without the need for adhesive strips.

In addition to possessing ply adhesion sufficient to retain the bandage in place, it should also possess optimum absorbency of body fluids, e.g. blood and wound exudate, or other fluids, so as to minimize the number or frequency of changes.

Ideally, it should also be characterized as being soft, highly conformable, and possessing good tensile strength.

The present invention is in essence directed to providing elastic bandages prepared according to the teachings of U.S. Pat. No. 4,173,131 and which are characterized as having improved ply adhesion and absorbency of wound fluids. In this context, the present invention can be said to be an improvement over the basic teachings of the Pendergrass patent.

The Pendergrass patented invention can be said to have as its foundation the discovery that by utilizing so-called false twisted filament yarns in the warp direction, with a staggered inlay of regular yarns in the cross direction, an elastic bandage can be produced which has stretch and power characteristics comparable with the characteristics of conventional elastic bandages of woven structure.

By "false-twist" yarns is meant a type of texturized continuous filament yarn which has been given increased bulk and loft, together with stretch, by the introduction in the yarn of crimps, loops, coils, and crinkles by false twisting. Such yarns are commercially produced by per se well known processes, and when the filamentary material is thermoplastic, as is the case, for example, with polyester and nylon materials, a heat setting stage in the false-twist process renders the stretch and crimped configuration of the yarn relatively permanent.

As stated in the patent, depending on the direction of rotation of the spindle, the yarn may be twisted clockwise or counterclockwise, giving rise to S-twist and Z-twist in the yarn. It is customary to employ yarns of both types of twist where it is desired to minimize torque and twist in a fabric, either as alternate warp yarns or as a yarn of one twist plied with yarn of opposite twist.

According to the Pendergrass patent, the warp yarns of the preferred bandage consist of false-twist S or Z yarns, knitted in a chain stitch with a false-twist yarn inlay. In order to minimize the tendency of knitted fabrics to narrow in when stretched, the chain-stitched warps are held in position by a series of interlocking filling yarns of conventional non-elastic type, preferably spun yarns, inlaid in a particular set of varying patterns. Nevertheless, conventional spun yarn, such as cotton yarn, does not provide sufficient ply adhesion to allow the bandage to remain in place without the need for adhesive strips.

In accordance with the present invention, the task of providing improved ply adhesion to the patented elastic bandages is solved by employing slack mercerized cotton yarn for the inlay filling.

The process of mercerizing, which has been known for over 150 years, involves the chemical treatment of cotton yarn or fabric with an alkaline mercerizing agent for a short period of time, e.g. less than four minutes. With proper wetting in the mercerizing bath, the time may be as little as 1 minute. Caustic soda (sodium hydroxide) is the preferred mercerizing agent since it is the least expensive and easier to control than most other swelling agents which have mercerizing effects. The material is then treated with water to remove the caustic.

Mercerization may be under tension or slack (no tension). If it is slack, a considerable gain in tensile strength may be obtained along with imparting elasticity to yarns or fabrics.

Mercerization is believed to change the physical form of cotton fibers rather than chemically modifying its structure. In mercerization, the untreated cotton fiber, which has a kidney-like appearance, swells to become roughly circular in cross section. This swelling action removes most of the twist, giving the fiber a rodlike form.

The fibers with a circular cross-section are shorter and of coarser count. Accordingly they are more rigid. Accordingly, the protruding ends of the cotton fiber on the yarn surface produce a higher interlocking effect with the protruding fiber of the yarn surface on the adjacent layer.

In the context of the present invention, the slack mercerized cotton yarn in the inlay filling of the contemplated elastic bandages, which shrinks and becomes stretchable after mercerization, is no longer planar with respect to the warp yarns of the bandage. These yarns have been found to assume a convoluted 3-dimensional configuration which engages the yarns on the adjacent bandage ply to provide the desired improved clinging characteristic. This imparts the increased ply adhesion which prevents the bandage plies from slipping, thus maintaining the ability of the bandage to perform its clinical function, whether as a primary dressing or to apply compression over a primary dressing.

The elastic bandages contemplated by this invention will in general have a ratio by weight of slack mercerized cotton fill to warp yarn of on the order of from 1:4 to 4:1; with a ratio of warp/fill of about 3:2 being preferred.

Suitable warp yarns include acrylic fibers such as orlon, polyamides such as nylon, polyolefins such as polypropylene and polyesters, texturized polyesters such as "Dacron"(trademark of E.I. duPont), "Enka"(-trademark of American Enka Co.), "Fortel"(trademark of Celanese Corp.), etc. being most preferred. Preferably, the warp yarn will consist essentially of Z inlay with S yarns knitted around the Z, the ratio by weight of S to Z being on the order of about 2:1.

While 30/1, 30/2, 40/1, 40/2, 60/1 and 60/2 slack mercerized cotton yarns have been utilized in the filling and all have provided improved results, other cotton counts or the number of yarns to be used are also envisioned.

The mercerizing step may be performed in known manner utilizing conventional mercerizing baths and accordingly per se comprises no part of this invention. By way of illustration, a 20–25 percent caustic solution may be employed without applying tension in order to permit maximum shrinkage of the cotton yarn. Typically, such shrinkage will be on the order of 40–50 percent. The resulting shortening and swelling of the cotton fibers in the yarn tighten the twist, producing kinks in the yarn, which kinks preclude easy sliding of fabric layers in a roll and thereby dramatically improve ply adhesion.

As heretofore mentioned, the task of the invention is to improve ply adhesion of elastic roll bandages prepared in accordance with the general teaching so U.S. Pat. No. 4,173,131. The standard test for ply adhesion as well as that for absorbency are described hereinafter.

MEASURING PLY ADHESION

Ply adhesion is measured using an Instron Model 1122 or 1130 equipped to measure and record shear load with an accuracy of plus or minus 2%. The samples to be measured are conditioned for 24 hours at 70° F. plus or minus 2° and 50 plus or minus 2% relative humidity. Two pieces 2 inches wide ×7 inches long are lined up, one over the other, so that there is a 5 inch overlap. The thus overlapping samples are then plied together using a hand roller meeting Pressure Sensitive Tape Council standards. [The roller is a steel roller, 3.25 inches ×1.75 inches, covered with a ¼" thick rubber having a shore scale A durometer hardness of 75 to 85. The cylindrical surface of the roller is void of any concave or convex deviations so that the roller will apply uniform pressure across the width of its entire surface. The weight of the roller proper, which applies pressure to the specimen, is 4.5 pounds.]The samples are plied together by centering the roller on the sample and slowly rolling the overlapped area back and forth one time in a machine direction to be sure the adjacent overlapping surfaces engage one another. The sample is then tested immediately after rolling by clamping the free end of each ply in the machine jaws and pulling to determine the ply adhesion (shear load) in grams-force. For accuracy, a minimum of ten tests are prepared and the mean in gram-force calculated.

MEASURING ABSORBENCY

The absorbency test is calculated to determine the time required to absorb a given amount of liquid and the maximum amount of liquid that can be absorbed, both important variables affecting end use performance.

Rate Of Absorption

The rate of absorption is expressed in terms of the time required for a weighed material dropped in water to sink to the bottom of a beaker. ("sink time"). The bandage roll (previously weighed to determine dry weight) is gently dropped horizontally from a height of two inches into a 4000 ml beaker at room temperature. The time required for the sample to sink is measured with a stop watch to the nearest 0.1 second.

Absorptive Capacity

After the bandage roll (previously weighed to determine dry weight) has dropped to the bottom of the beaker, it is allowed to remain submerged for an additional 60 seconds. It is then gently removed from the water. Holding the roll vertically from a height of 2 inches, it is allowed to drain for 60 seconds. It is then placed on a watch glass and weighed, thus determining the wet weight. By simple subtraction of dry weight from wet weight, the absorption capacity is determined.

In performing the above tests, the bandage roll samples are first conditioned in an atmosphere of 65% relative humidity plus or minus 2% at 70° F. plus or minus 2° for at least four hours. The above tests are repeated for a minimum of five tests, changing the water after each test.

PREFERRED EMBODIMENT OF THE INVENTION

With reference to the accompanying drawing, the following description illustrates a preferred embodiment of the invention.

Using a crocheting machine, a bandage was constructed utilizing five yarn guide bars per repeat operating in a vertical plane perpendicular to the horizontal needles, four of the bars moving across the width of the fabric to insert the mercerized cotton inlay filling yarns of 40/2 cotton and the fifth bar being utilized to insert the inlaid false-twist yarn 10*a* or 10*b*. The inlay filling yarn pattern was that shown in FIGS. 2, 3, 4 and 5, each of the guide bars operating independently. The composite false-twist yarns 10 were 70/1/34z twist inlay and 70/1/34s twist chain stitch Superloft nylon, a trade name for false-twist yarns made on a Lessona false-twist apparatus. There were nine warp yarns, 12A, 12B, 12C and 12D, respectively, in each repeat, a total of 57 needles being used in the production of a four-inch (10 centimeter) bandage with 14 composite warp yarns per inch (5.5 yarns per centimeter). The inlay filling yarn of 40/2 cotton was inserted at the rate of 17 courses per inch (6.7 yarns per centimeter).

Figure 6:
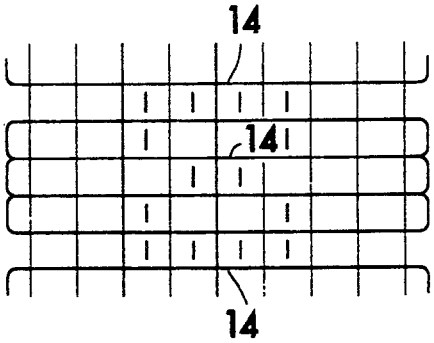
FIG. 6, which is identical to FIG. 9 of the 3 131 patent, is a composite of FIGS. 2, 3, 4 and 5.

As seen in FIG. 1, the mercerized cotton inlay filling yarn is inlaid into each of the loop-forming S yarns in the composite warp yarns. FIGS. 2, 3, 4 and 5 illustrate the particular patterns with which each of the four inlay filling yarns is deployed, to form the composite filling yarn structure shown in FIG. 6.

The bandage as formed on the machine has a weight of about 75 grams per square yard or 90 grams per square meter. It is then conditioned by passing it rapidly through a steam chamber, e.g. at a temperature of on eth eorder of 210°–212° F. for about 2–3 seconds, in order to shrink it. The resulting bandage exits from the steam chamber in a related condition, after which it is rapidly dried. During this steaming process the bandage undergoes shrinkage, increasing in weight to about 88 grams per square yard or 105 grams per square meter. In addition, the filling yarns are relaxed from their off-machine, regular configuration to the cursive configuration shown in FIG. 1. This relaxation builds slack into the filling yarns, and in part accounts for the ability of the bandage to be stretched without an accompanying decrease in width.

At 100% elongation the bandage had 9 courses or filling yarns per inch (3.5 per centimeter) with 14 composite warp yarns per inch. Since the filling yarns were 40/2, the filling cover factor was about 2, an extremely low factor characteristic of open-mesh netting. Cover factor is a measure of the degree of openness of a fabric, and is calculated as the number of yarns per inch divided by the square root of the yarn count in the cotton system. In the bandages of this invention, the number of filling yarns per inch of bandage under 100% extension preferably lies within the range of 8 to 20 (3 to 7.5 per centimeter) with the filling yarns ranging from 20's to 60's in count, so that the cover factor is less than 5.

This low cover factor in the filling brings the crimped, curled and looped nature of the warp yarns into prominence as a dominant surface characteristic of the bandages. The use of mercerized cotton as taught by this invention under the above fabric surface characteristic condition enhances the adhesion between fabric layers significantly. When the bandage is applied to a body member in the customary overlapping layer procedure, each layer of the bandage clings firmly to each adjacent layer with which it is in contact, due to the interlocking of the crimps and curls of the warp yarns in one layer with the warps in adjacent layers and with the open, widely-spaced mercerized filling yarn structure. Thus the bandage resists slipping and displacement as the body member is flexed during movement, an advantage not present in conventional elastic bandages.

The following examples show by way of illustration and not by way of limitation the practice of this invention.

EXAMPLE 1

In the manner described in the aforementioned Pendergrass patent, a control and a test sample were prepared:

| Sample | Knit | Inlay | Fill | Stitches/ minute |
|---|---|---|---|---|
| Control | TEX'S'70/1/34 | TEX'Z'70/1/34 | 30/1 (nonmerc) | 7 |
| Test | " | " | 40/2 (merc) | 7 |

As seen, the control utilized a 30/1 nonmercerized cotton filling; while the test utilized a 40/2 mercerized cotton filling. In the warp, both possessed the same texturized (TEX) S and Z polyester yarns.

The respective Control and Test exhibited the following physical characteristics:

| | CONTROL | TEST |
|---|---|---|
| WIDTH (inches) | 4.01 | 3.64 |
| THICKNESS (inches) | 0.030 | 0.034 |
| ROLL WEIGHT (grams) | 12.71 | 16.14 |
| GROWTH & RECOVERY | | |
| Relaxed Length, inches | 97.90 | 101.30 |
| Stretched Length, inches | 156.60 | 161.40 |
| % Stretch | 59.90 | 59.30 |
| Length after stress removed | 99.90 | 105.50 |
| % Growth | 2.00 | 3.40 |
| % Recovery | 98.00 | 96.60 |

EXAMPLE 2

The Control and Test prepared in the foregoing example were subjected to testing for ply adhesion and absorption in the manner previously described in detail. The test results are as follows:

| | CONTROL | TEST | % IMPROVEMENT |
|---|---|---|---|
| PLY ADHESION | 18.73 | 30.06 | 60% |
| ABSORBENCY | | | |
| Sink time, seconds | 3.0 | 2.6 | 13% |
| Absorptive Capacity, grams | 94.27 | 102.82 | 9% |

From the foregoing illustrative examples it will be seen that without compromising other desired properties, the present invention provides very substantial improvement in both ply adhesion and absorbency characteristics.

While not necessary to the practice of the invention, the edges of the bandage are preferably of unmercerized bleached yarn so as to provide clean sealed edges.

Apart from the above-noted properties of stretchability, high ply adhesion, improved absorbency, and being adhesive-free, the elastic bandages of this invention are further characterized as being highly conformable, strong, clean, lint-free and as being characterized as soft, lofty, fluffy and cushy.

In the foregoing description, reference has been restricted to knitted elastic bandages wherein all of the cotton inlay filling yarns have been mercerized.

It has been discovered, however, that while improved results are not as dramatic, significant beneficial results are still obtained if at least half of the cotton yarns are mercerized, the remaining yarns being nonmercerized. Thus in a standard knitting operation having 7 ends of inlay filling yarns, it is within the scope of this invention to employ 3 ½ ends of each.

Since mercerization increases the cost of the bandage manufacture, in some instances it may be desirable to opt for the reduced cost at the sacrifice of less than maximum improvements derived from mercerization of all of the inlay filling yarns. Accordingly it is within the scope of this invention to mercerize at least half but less than all of the cotton inlay filling yarns.

The following table compares the ply adhesion of 100% of yarns mercerized vs. 50% mercerized filling yarns.

TABLE 1

| 3 inch Bandage Roll | *Ply Adhesion (Grams) |
|---|---|
| Control (no mercerizing) | 18.41 |
| 40/1 100% mercerized | 26.51 |
| 40/1 50% mercerized | 20.10 |
| 30/1 100% mercerized | 32.60 |
| 30/1 50% mercerized | 23.60 |
| 30/2 100% mercerized | 38.03 |
| 30/2 50% mercerized | 27.30 |

*The numerical values represent the mean ply adhesion after running each test a number of times.

From the foregoing Table it will be seen that while superior improvement is obtained in all instances where all the inlay filling yarn has been mercerized, meaningful improvement in ply adhesive was nevertheless derived in every instance where only 3 ½ picks (50%) of the cotton yarns were mercerized.

As heretofore described, the present invention also provides significantly improved absorption capability. Independent testing has shown, for example, an increase of moisture regain from 6.65% for an unmercerized cotton yarn to 10.42% for the same yarn mercerized. This increase is believed to be due to the increased hydrophilic properties of the mercerized cotton yarn provided by the mercerization step which opens up the yarn to expose more hydroxyl groups to moisture.

By way of recapitulation the present invention is particularly directed to improvements in the porous elastic bandages described in the aforementioned U.S. Pat. No. 4,173,131 of Pendergrass.

As is described and claimed therein, a self-supporting, open mesh knitted elastic bandage is provided which is characterized by the tendency of overlapping layers of the bandage to cling to each other in relatively non-displaceable relationship, the bandage comprising a set of composite parallel warp yarns comprising a first false-twist yarn formed into stitch loop chains with a second false-twist yarn inlaid into the loops of the first false-twist yarn, the second false-twist yarn being of opposite twist from the twist of the first false-twist yarn, and a plurality of individual inlay filling yarns describing varied and cursive patterns across the set of composite warp yarns and being inlaid therewith, the varied and cursive patterns of inlay filling yarns overlapping one with another across a substantial portion of the width of the bandages, no individual inlay filling yarn pattern extending across more than a minor portion of the width of the bandage, and at least a portion of the length of the inlay filling yarns lying in slack looped configuration on the surface of the bandage. As further disclosed therein, the warp yarns will preferably consist alternately of chain stitch false twist S yarns with a false twist Z yarn inlay and chain-stitch false-twist Z yarns with a false-twist S yarn inlay. Further, pairs of inlay filling yarns may be arranged in reciprocating diagonal fashion across a plurality of said warp yarns and other pairs of inlay filling yarns arranged in alternating mirror-image fashion across a plurality of the warp yarns, the inlay filling yarns overlapping with each other across a substantial portion of the warp yarns.

As heretofore described in detail, in accordance with the present invention very significant improvements in both ply adhesion and absorbency in the Pendergrass elastic bandages are obtained by employing slack mercerized cotton for the filling yarns.

While the invention has been described in detail for the production of porous plastic bandages, e.g. secondary bandages such as those manufactured in roll form, it will be appreciated that the invention is not limited thereto.

The absorbent elastic fabric provided by the present invention may, for example, find use in the manufacture of various articles of apparel such as disposal hats and hairnets, stockings and other articles of footwear, etc.

Since various changes may be made without departing from the scope of the invention herein contemplated, it is to be understood that the foregoing description, including the examples, shall be taken as illustrative and not in a limiting sense.

What is claimed is:

1. In a knitted elastic fabric characterized by the tendency of overlapping layers of the fabric to cling to each other, having a set of composite parallel warp yarns comprising a first false-twist yarn formed into stitch loop chains with a second false-twist yarn inlaid into the loops of the first false-twist yarn, the second false-twist yarn being of the opposite twist from the twist of the first false-twist yarn, and a series of interlocking cotton inlay filling yarns inlaid in a set of varying cursive patterns holding the warp yarns in position;

the improvement comprising at least a portion of the cotton inlay filling yarns being slacked mercerized whereby to provide increased play adhesion.

2. An elastic fabric as defined in claim 1 wherein substantially all the cotton inlay filling yarns are slack mercerized.

3. An elastic fabric as defined in claim 2 wherein the ratio by weight of slack mercerized cotton fill to warp yarn is of on the order of from about 1:4 to about 4:1.

4. An elastic fabric as defined in claim 2 wherein the ratio by weight of slack mercerized cotton fill to warp yarn is about 3:2.

5. An elastic fabric as defined in claim 2 wherein the warp yarn is selected from the group consisting of acrylic, polyamide, polyolefin and polyester yarns.

6. An elastic fabric as defined in claim 2 wherein the warp yarn is a texturized polyester.

7. An elastic fabric as defined in claim 2 wherein the warp yarn consists essentially of Z inlay with S yarns knitted around the Z yarns.

8. An elastic fabric as defined in claim 7 wherein the ratio by weight of S yarns to Z yarns is about 2:1.

9. An elastic fabric as defined in claim 1 wherein the inlay filling yarns are selected from the group consisting of 30/1, 30/2, 40/1, 40/2, 60/1 and 60/2 slack mercerized cotton yarns.

10. An elastic fabric as defined in claim 1 in which the warp yarns consist alternately of chain-stitch false-twist S yarns with a false-twist Z yarn inlay and chain stitch false-twist Z yarns with a false-twist S yarn inlay.

11. An elastic fabric as defined in claim 10 in which pairs of inlay filling yarns are arranged in reciprocating diagonal fashion across a plurality of the warp yarns, and other pairs of inlay filling yarns are arranged in alternating mirror-image fashion across a plurality of the warp yarns, the inlay filling yarns overlapping with each other across a substantial portion of the warp yarns.

12. In a knitted elastic fabric characterized by the tendency of overlapping layers of the fabric to cling to each other, having a set of composite parallel polyester or polyester/cotton blend warp yarns comprising a first false-twist yarn formed into stitch loop chains with a second false-twist yarn inlaid into the loops of the first false-twist yarn, the second false-twist yarn being the opposite twist from the twist of the first false-twist yarn, and a series of interlocking cotton inlay filling yarns inlaid in a set of varying cursive patterns holding the warp yarns in position;

the improvement comprising at least a portion of the cotton inlay filling yarns being slacked mercerized whereby to provide increased ply adhesion, the ratio by weight of the slack mercerized cotton inlay filling yarn to warp yarn being on the order of from about 1:4 to about 4:1.

13. An elastic bandage as defined in claim 12 wherein the warp yarn is a texturized polyester.

14. An elastic bandage as defined in claim 13 wherein the warp yarn consists essentially of Z inlay with S yarns knitted around the Z yarns.

15. An elastic bandage as defined in claim 14 wherein the ratio by weight of S yarns to Z yarns is about 2:1.

16. An elastic bandage as defined in claim 12 wherein the inlay filling yarns are selected from the group consisting of 30/1, 30/2, 40/1, 40/2, 60/1 and 60/2 slack mercerized cotton yarns.

17. An elastic bandage as defined in claim 16 wherein the warp yarns consist alternately of chain-stitch false-twist S yarns with a false-twist Z yarn inlay and chain-stitch false-twist Z yarns with a false-twist S yarn inlay.

* * * * *